US009175358B2

(12) United States Patent
Sarir et al.

(10) Patent No.: US 9,175,358 B2
(45) **Date of Patent: *Nov. 3, 2015**

(54) COMPOSITIONS AND PROCESSES FOR SUGAR TREATMENT

(75) Inventors: Emmanuel M. Sarir, Los Angeles, CA (US); James Bushong, Collegeville, PA (US)

(73) Assignee: Carbo-UA Limited, Beverly Hills, CA (US)

( * ) Notice: Subject to any disclaimer, the term of this patent is extended or adjusted under 35 U.S.C. 154(b) by 158 days.

This patent is subject to a terminal disclaimer.

(21) Appl. No.: 12/893,514

(22) Filed: Sep. 29, 2010

(65) Prior Publication Data

US 2011/0108021 A1 May 12, 2011

Related U.S. Application Data

(60) Provisional application No. 61/260,170, filed on Nov. 11, 2009.

(51) Int. Cl.
*C13B 10/14* (2011.01)
*C13B 20/12* (2011.01)

(52) U.S. Cl.
CPC ..... *C13B 20/123* (2013.01)

(58) Field of Classification Search
None
See application file for complete search history.

(56) References Cited

U.S. PATENT DOCUMENTS

| | | | | |
|---|---|---|---|---|
| 1,646,079 | A | 10/1927 | Battelle | |
| 1,788,466 | A * | 1/1931 | Lourens | 502/417 |
| 1,815,276 | A * | 7/1931 | Schwieger | 127/48 |
| 1,956,260 | A * | 4/1934 | Wadsworth et al. | 127/48 |
| 2,067,362 | A * | 1/1937 | Von Stietz | 127/48 |
| 2,104,959 | A * | 1/1938 | Von Stietz | 127/50 |
| 2,170,601 | A | 8/1939 | Wilson et al. | |
| 2,194,195 | A | 3/1940 | Feurtado | |
| 2,249,920 | A | 7/1941 | Taussig et al. | |
| 2,261,920 | A | 11/1941 | Graff et al. | |
| 2,430,262 | A | 11/1947 | Vincent et al. | |
| 2,652,152 | A * | 9/1953 | Frankenhoff | 210/778 |
| 2,672,428 | A | 3/1954 | Sklar et al. | |
| 2,829,986 | A | 4/1958 | Ehrhart | |
| 2,977,253 | A | 3/1961 | Grandadam et al. | |
| 3,097,114 | A * | 7/1963 | Assalini | 127/46.2 |
| 3,166,442 | A | 1/1965 | Duke | |
| 3,248,264 | A | 4/1966 | Welch | |
| 3,420,709 | A | 1/1969 | Barrett, Jr. et al. | |
| 3,454,502 | A * | 7/1969 | Hiltgen et al. | 502/401 |
| 3,539,393 | A | 11/1970 | Silva et al. | |
| 3,698,951 | A * | 10/1972 | Bennett | 127/48 |
| 3,806,364 | A | 4/1974 | Gasco | |
| 3,853,616 | A | 12/1974 | Rundell et al. | |
| 3,909,287 | A | 9/1975 | Rundell et al. | |
| 3,973,986 | A | 8/1976 | Schoenrock et al. | |
| 4,081,288 | A | 3/1978 | Torres | |
| 4,101,338 | A | 7/1978 | Rapaport et al. | |
| 4,196,017 | A * | 4/1980 | Melville et al. | 127/41 |
| 4,196,071 | A * | 4/1980 | Wood et al. | 204/266 |
| 4,247,340 | A | 1/1981 | Cartier | |
| 4,288,551 | A | 9/1981 | Gudnason et al. | |
| 4,292,285 | A * | 9/1981 | Nakao et al. | 423/210 |
| 4,345,947 | A * | 8/1982 | Rundell et al. | 127/48 |
| 4,382,823 | A | 5/1983 | Gudnason | |
| 4,478,645 | A | 10/1984 | Gudnason | |
| 4,502,890 | A | 3/1985 | Urbanic | |
| 4,737,293 | A * | 4/1988 | Walterick et al. | 210/666 |
| 5,262,328 | A | 11/1993 | Clarke et al. | |
| 5,281,279 | A | 1/1994 | Gil et al. | |
| 5,865,899 | A | 2/1999 | Theoleyre et al. | |
| 5,891,254 | A | 4/1999 | Coville et al. | |
| 5,932,016 | A | 8/1999 | Paananen et al. | |

(Continued)

FOREIGN PATENT DOCUMENTS

| | | | |
|---|---|---|---|
| CN | 85108102 | A | 5/1987 |
| CN | 1040624 | A | 3/1990 |

(Continued)

OTHER PUBLICATIONS

English abstract of JP58014933.* Cane Sugar Handbook, 12th Ed., pp. 454-455.
Cane Sugar Handbook, 12th Ed., pp. 463-464.
Cane Sugar Handbook, 12th Ed., p. 634.
Abdel-Razig et al., Effect of Addition of Separan at Different Concentrations as a Flocculants on Quality of Sugar Cane Juice, International Journal of Biological and Life Sciences, 2010, pp. 88-91, vol. 6, No. 2.
International Search Report of PCT/US10/56381 dated Feb. 28, 2011.

(Continued)

*Primary Examiner* — Melvin C Mayes
*Assistant Examiner* — Stefanie Cohen
(74) *Attorney, Agent, or Firm* — Venable LLP; Robert Kinberg; Therese M. Finan

(57) ABSTRACT

A composition and process for treating sugar solutions that includes one or more sources of ammonium that obtain a pH in water solution above pH 7.0, such as ammonium bicarbonate ($NH_4HCO_3$), ammonium phosphate dibasic $(NH_4)_2HPO_4$, and ammonium sulfite $(NH_4)_2SO_3$. The composition can also include a particulate sulfur reagent, an amorphous silica, a particulate aluminum reagent, a particulate phosphorous reagent, a particulate filter aid selected from diatomaceous earth and perlite, a particulate activated carbon, a particulate bleaching earth, a polymer decolorant, or combinations thereof. The individual materials can be premixed before addition to the sugar solution, added individually to the sugar solution, or added as a combination of one or more singular ingredients and one or more pre-mixed ingredients. The invention can stabilize the pH of the sugar solution, reduce the calcium, magnesium or related ash constituents of the sugar solution, achieve color reduction of the sugar solution, or some combination of these effects.

9 Claims, No Drawings

(56) References Cited

U.S. PATENT DOCUMENTS

| | | | | |
|---|---|---|---|---|
| 6,146,465 | A | 11/2000 | Xavier et al. | |
| 6,159,302 | A * | 12/2000 | Xavier et al. | 127/57 |
| 6,267,889 | B1 * | 7/2001 | Woerner | 210/636 |
| 6,368,413 | B1 | 4/2002 | Charlet et al. | |
| 6,375,751 | B2 | 4/2002 | Reisig et al. | |
| 6,835,311 | B2 * | 12/2004 | Koslow | 210/490 |
| 8,080,088 | B1 * | 12/2011 | Srinivasachar | 95/107 |
| 8,486,473 | B2 | 7/2013 | Sarier et al. | |
| 8,486,474 | B2 | 7/2013 | Sarier et al. | |
| 2001/0001178 | A1 | 5/2001 | Donovan et al. | |
| 2002/0011246 | A1 | 1/2002 | Reisig et al. | |
| 2005/0229813 | A1 | 10/2005 | Dionisi et al. | |
| 2006/0090749 | A1 | 5/2006 | Rein et al. | |
| 2007/0224332 | A1 * | 9/2007 | Sugimoto et al. | 426/597 |
| 2007/0275119 | A1 | 11/2007 | Lakkis | |
| 2009/0050135 | A1 | 2/2009 | Zschau et al. | |
| 2012/0216799 | A1 | 8/2012 | Bolanos | |

FOREIGN PATENT DOCUMENTS

| | | | |
|---|---|---|---|
| CN | 1045420 | A | 10/1999 |
| CN | 1300857 | A | 6/2001 |
| CN | 1560281 | A | 1/2005 |
| CN | 1609234 | A | 4/2005 |
| CN | 1629320 | A | 6/2005 |
| CN | 1687461 | A | 10/2005 |
| CN | 1912143 | A | 2/2007 |
| CN | 1958811 | A | 5/2007 |
| CN | 101003370 | A | 7/2007 |
| CN | 101003842 | A | 7/2007 |
| CN | 101082065 | A | 12/2007 |
| CN | 101243194 | A | 8/2008 |
| CN | 101440412 | A | 5/2009 |
| CN | 101818214 | A | 9/2010 |
| EP | 0635578 | A1 | 1/1995 |
| JP | 58014933 | A * | 1/1983 |
| MX | 2007016295 | A | 6/2009 |
| WO | WO-96/15274 | A1 | 5/1996 |
| WO | WO-99/55918 | A2 | 11/1999 |
| WO | WO-00/42226 | A1 | 7/2000 |
| WO | WO/2011/060168 | R3 | 1/2011 |
| WO | WO2011/059601 | A1 | 5/2011 |
| WO | WO2011/059601 | R3 | 5/2011 |
| WO | WO-2011/059601 | R3 | 5/2011 |
| WO | WO/2011/060168 | A1 | 5/2011 |
| WO | WO-2011/060168 | R3 | 5/2011 |
| WO | WO/2011/060168 | R3 | 5/2011 |
| WO | WO2011/060169 | A1 | 5/2011 |
| WO | WO2011/060169 | R3 | 5/2011 |
| WO | WO2011/079172 | A1 | 6/2011 |

OTHER PUBLICATIONS

"Review of Proven Technologies Available for the Reduction of Raw Sugar Color" Proc S Afr Technol Assoc. (2008) 81, 165-183. Mando et al.

International Preliminary Report on Patentability issued in Application No. PCT/US2010/051501 dated May 15, 2012.

International Search Report issued in Application No. PCT/US2010/051501 dated Nov. 30, 2010.

International Search Report issued in Application No. PCT/US2010/05638 dated Jan. 13, 2011.

International Search Report issued in Application No. PCT/US2010/061728 dated Feb. 24, 2011.

Office Action issued in U.S. Appl. No. 12/942,078 dated Jun. 8, 2012.

Office Action issued in U.S. Appl. No. 12/942,082 dated Jun. 14, 2012.

Restrictions Requirement issued in U.S. Appl. No. 12/970,387 dated Mar. 8, 2012.

Written Opinion of the International Searching Authority issued in Application No. PCT/US2010/056381 dated Feb. 28, 2011.

Written Opinion of the International Searching Authority issued in Application No. PCT/US2010/061728 dated Feb. 24, 2011.

Supplementary European Search Report of European Application No. EP10830731 dated Feb. 26, 2014.

Supplementary European Search Report of European Application No. EP10840101.9 dated Mar. 21, 2014.

Office Action issued in U.S. Appl. No. 13/940,979 dated Jul. 24, 2014.

Office Action issued in U.S. Appl. No. 13/940,970 dated Jul. 24, 2014.

Office Action issued in U.S. Appl. No. 13/940,979 dated Feb. 26, 2015.

Office Action issued in U.S. Appl. No. 13/940,970 dated Apr. 3, 2015.

Office Action issued in U.S. Appl. No. 12/970,387 dated Dec. 31, 2014.

Non-final Office Action issued in U.S. Appl. No. 12/970,387 dated Jan. 7, 2013.

Final Office Action issued in U.S. Appl. No. 12/970,387 dated Aug. 13, 2013.

Advisory Action issued in U.S. Appl. No. 12/970,387 dated Jan. 24, 2014.

Non-final Office Action issued in U.S. Appl. No. 12/970,387 dated Mar. 25, 2014.

Supplemetary European Search Report of European Application No. EP10830731 dated Feb. 26, 2014.

Supplementary European Search Report of European Application No. EP10830732 dated Mar. 12, 2014.

Davis, SB, The Chemistry of Colour Removal: A Processing Perspective, Proc s Afr Sug Technol Assoc, 2001; 75:328336.

* cited by examiner

COMPOSITIONS AND PROCESSES FOR SUGAR TREATMENT

BACKGROUND OF THE INVENTION

1. Field of the Invention

The present invention relates generally to methods of treating sugar liquors, syrups, juices, and related products, offering compositions of matter and processes incorporating the same.

2. Description of the Prior Art

The use of activated carbon to decolorize sugar solutions is a well-established technology (Cane Sugar Handbook, 12$^{th}$ Ed., pgs. 463-464). The traditional process incorporates either a granular activated carbon (GAC) or powder activated carbon (PAC). In the granular carbon process, the GAC is packed in a tower, and impure sugar flows through the packed towers. The effluent from the tower is thus more pure, due to the decolorization power of the GAC. To prevent pH drop of the sugar liquor, about 5% magnesite (MgO) can be mixed with the GAC (Cane Sugar Handbook, 12$^{th}$ Ed., pg. 463). In the powder carbon process, the carbon is traditionally used as either a batch-contact followed by filtration to retire the powder carbon, or the powder carbon can be used as a precoat on the filters (Cane Sugar Handbook, 12$^{th}$ Ed., pg 464). In the batch-contact PAC method, a filter aid (usually diatomaceous earth or perlite) is almost always used, at a ratio of approximately 1:1 in weight to the PAC dosage. The filter aid assists with the filtration of impurities in the sugar, as well as assists with the filtration of the powder carbon particles. Generally speaking, the PAC is not buffered with another material (unlike the typical ~5% MgO buffering of the GAC.)

In the sugar production processes, it is generally desirable to avoid or at least minimize sucrose sugar losses due to inversion of the sucrose into glucose and fructose. Inversion of sucrose occurs under acidic conditions (pH less than 7.0). Some sources advocate maintaining pH of all liquors and syrups (throughout the sugar production process) to be kept over pH 7.0 to avoid/minimize inversion of the sucrose sugars (Cane Sugar Handbook, 12$^{th}$ Ed., pg. 634). Many activated carbons for use in sugar purification are acidic in nature; this is due to the well-known property of acidic activated carbons to possess a greater ability to decolorize sugar juices, liquors, and syrups. Without buffering (with a base such as MgO previously mentioned for use with GAC), there is a risk of inversion losses in the sugar solutions treated with acidic activated carbons.

In other sugar processes, it is desirable to remove certain ash constituents such as calcium and magnesium. Calcium and magnesium can be naturally occurring in the sugar solutions, or added as part of a clarification process; for example, the sugar refinery industry standard clarification methods of carbonatation and phosphatation both utilize lime ($Ca(OH)_2$) addition to the sugar solutions. Other examples of introducing calcium or magnesium into the sugar purification process include adding lime or milk of magnesia ($Mg(OH)_2$) to the juice extracted from cane or beet sugars. In any of these situations, the calcium and magnesium in the sugar can beneficially react to remove a variety of impurities, usually with a mechanism of forming insoluble precipitate complexes between the impurities and calcium and or magnesium. However in most cases there is always residual calcium and magnesium that remains unreacted; the unreacted calcium and magnesium can cause undesirable side effects such as the formation of scale on evaporators. Therefore it is desirable to find methods that reduce the amount of unreacted calcium and magnesium during the sugar purification process.

More recent processes for sugar liquor and syrup clarification include those exemplified by U.S. Pat. No. 5,281,279 to Gil et al. This patent describes a process for producing refined sugar from raw sugar juices. The process includes adding a flocculant for treating raw sugar juice, wherein the flocculant is selected from the group of lime, a source of phosphate ions, polyelectrolyte, and combinations thereof. The thus treated juice is concentrated by evaporation to form a syrup, with a subsequent treatment by flocculant, then filtered, and then decolorized and de-ashed using ion-exchange resin.

In U.S. Pat. No. 4,247,340, Cartier claims a process for purifying impure sugar solutions, including simultaneous decolorization and clarification, comprising contacting the impure sugar solutions with submicroscopic ion-exchange resin in the forms of approximately spherical beads, said ion-exchange resin having diameters from about 0.01 to 1.5 microns, followed by separation of this ion-exchange resin from the sugar solution. The ion-exchange resin particles may be separated in the form of a floc, wherein the floc may be formed either from impurities in the impure sugar solution, or by adding sufficient flocculating agent in the sugar solution to flocculate all of the resin particles.

Another example of more recently proposed sugar clarification includes that of U.S. Pat. No. 5,262,328 to Clarke et al, detailing a composition for the clarification of sugar bearing juices and related products. The composition comprises a dry, powdered admixture of aluminum chloride hydroxide, lime, and activated bentonite. The composition may also include a polymer flocculating agent, such as a polyacrylamide.

SUMMARY OF THE INVENTION

In light of the information described above, it is the object of the present invention to provide compositions of matter and processes incorporating the same, for treating sugar liquors, syrups, juices, and related products (hereafter collectively referred to as "sugar solutions"). The compositions can provide buffering to the sugar solutions. Exemplary embodiments can provide for decolorization of the sugar solutions with less of a pH drop than conventional activated carbons. Further exemplary embodiments can also provide reductions in ash constituents such as calcium and magnesium. The compositions provided in this invention are mixed intimately into the sugar solutions, and allowed sufficient time to react with the sugar solutions so as to impart either a buffering to the sugar solution, a color reduction to the sugar solution, a reduction in ash constituents such as calcium or magnesium, or any combination of buffering, color reduction, or ash reduction to the sugar solution. In one embodiment, the invention is a composition for treating sugar solutions that includes one or more sources of ammonium that obtain a pH in water solution above pH 7.0. Examples of sources of ammonium include ammonium bicarbonate ($NH_4HCO_3$), ammonium phosphate dibasic $(NH_4)_2HPO_4$, and ammonium sulfite $(NH_4)_2SO_3$. In some embodiment, the composition includes one or more materials selected from a particulate sulfur reagent, an amorphous silica, a particulate aluminum reagent, a particulate phosphorous reagent, a particulate filter aid selected from diatomaceous earth and perlite, a particulate activated carbon, a particulate bleaching earth, a polymer decolorant, and combinations thereof. Exemplary embodiments of compositions also include at least one particulate activated carbon; a particulate filter aid selected from diatomaceous earth and perlite, or combinations thereof; at least one of a bleaching earth or an amorphous silica; or a combination of at least one of a bleaching earth and an amorphous silica. An exemplary composition of the invention includes at least one compound containing a source of ammonium ($NH_4$) that obtains a pH in water solution above pH 7.0, at least one particulate activated carbon, and at least one polymer decolorant and can also optionally include one or more components selected from a particulate sulfur reagent, an amorphous silica, a particulate aluminum reagent, a particulate phosphorous reagent and a particulate filter aid selected from diatomaceous earth and perlite, and combinations thereof. The individual materials can be pre-mixed before addition to the sugar solution, added individually to the sugar solution, or added as a combination of one or more singular ingredients and one or more pre-mixed ingredients.

In other embodiments, the invention is a sugar treatment process comprising adding one or more sources of ammonium that obtain a pH in water solution above pH 7.0 to a sugar solution. The process can stabilize the pH of the sugar solution, reduce the calcium, magnesium or related ash constituents of the sugar solution, achieve color reduction of the sugar solution, or some combination of these effects. For example, the source of ammonium can control the pH of the sugar solution by raising the pH of the sugar solution if the sugar solution is acidic or by lowering the pH of the sugar solution if the sugar solution is alkaline. Any one or more of the compositions described above can be utilized in the inventive sugar treatment process. In embodiments that use a polymer decolorant solution, the process can include preparing a polymer decolorant solution and adding the one or more sources of ammonium to the polymer decolorant solution to prepare a treatment composition which is added to the sugar solution.

Further novel features and other objects of the present invention will become apparent from the following detailed description, discussion and the appended claims.

DETAILED DESCRIPTION

Although specific embodiments of the present invention will now be described, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The compositions provided in this invention are mixed intimately into the sugar solutions, and allowed sufficient time to react with the sugar solutions so as to impart either a buffering to the sugar solution, color reduction to the sugar solution, ash reduction to the sugar solution (such as reduction of calcium and magnesium), or any combination of buffering, color reduction, or ash reduction to the sugar solution. In exemplary embodiments, the particle size of any particulate utilized in the composition can be in the range of, or have an average particle size in the range of, for example, from about 0.01 micron up to about 300 microns; from about 1 micron to about 300 microns; from about 30 microns to about 300 microns; or from about 50 microns to about 250 microns.

The term "buffer" as defined herein shall refer to any neutralization of acid or base conditions, regardless of the mechanism. For example, the mechanism of buffering can be a Brønsted acid or base mechanism, or a Lewis acid or base mechanism of conventional chemistry.

The term "sugar solution" as used herein refers to any juice, liquor, or syrup containing a sugar. In exemplary embodiments, the sugar is derived from a plant source such as. for example, corn, cane of beets. Examples of sugar solutions include solutions of cane or beet sugar juices, liquors or syrups, starch hydrolyzate derived sweeteners such as high-fructose corn syrup and glucose, or others that are used in the art.

The term "polymer decolorant" as defined herein, refers to any of the organic polymers that can be used in sugar purification processing, such as those that contain a positive charge on a nitrogen atom, including for example, dimethylamine-epichlorohydrin, dimethyldialkylammonium chloride, or dimethyl-di-tallow ammonium chloride. It is noted, that the polymer decolorant can be prepared as a diluted solution in water or other suitable solvent; the weight percent of the polymer decolorant of the mixture is defined herein as the weight percent of the polymer solution added to the mixture, regardless of whether the polymer solution is added in the "as-is commercially available state" or in a "further diluted state" with water or other suitable solvent. If the polymer decolorant is first diluted in water or other suitable solvent, it can be diluted from about 5 to 95% by weight of polymer in the "as-is commercially available state" with respect to the solvent, for example from about 10 to 80% by weight of polymer in the "as-is commercially available state", or from about 40 to 75% by weight of polymer in the "as-is commercially available state", with the balance containing water or other suitable solvent.

The term "particulate filter aid" as defined herein, refers to any particulate filter aid that can be used in sugar purification processing such as, for example, diatomaceous earth or perlite filter aids.

Several compositions of matter have been identified for incorporation in the process of the present invention. In the simplest form, the composition contains a compound that is a source of ammonium ($NH_4^+$) that obtains a pH in water solution greater than 7.0, such as, for example, ammonium bicarbonate ($NH_4HCO_3$) or ammonium phosphate dibasic ($(NH_4)_2HPO_4$) or ammonium sulfite ($(NH_4)_2SO_3$), or any combination of ammonium bicarbonate or ammonium phosphate dibasic or ammonium sulfite, is added to the sugar solution.

Other compositions of matter have been identified for incorporation in the process of the present invention. The compositions include the compound containing a source of ammonium ($NH_4^+$) that obtains a pH in water solution greater than 7.0, plus one or more components selected from a particulate sulfur reagent, a particulate phosphorous reagent, a particulate aluminum reagent, a particulate silica reagent, a particulate carbonaceous reagent, a particulate bleaching earth, a particulate filter aid, and a polymer decolorant. Some of the components of the present compositions have been previously utilized in the sugar purification process. However, it has been found that treatment with the compositions provided in the present invention can provide superior results and advantages over existing processes.

A particulate sulfur reagent is a particulate solid that includes at least one sulfur atom and at least three oxygen atoms in the chemical formula (abbreviated hereafter as a "particulate $S_yO_x$ compound" where y is generally 1-2, and $x \geq 2.0y$. In exemplary particulate sulfur reagents, when y=1, x is 3 or more, and when y=2, x=4 or more). Examples of sulfur reagents include sulfite ($SO_3^{2-}$) salts, bisulfite ($HSO_3^-$) salts, sulfate ($SO_4^{2-}$) salts, hydrogen sulfate ($HSO_4^-$) salts, metabisulfite ($S_2O_5^{-2}$) salts, hydrosulfite ($S_2O_4^2$) salts, and others. Specific examples include sodium sulfite, ammonium sulfite, sodium bisulfite, sodium metabisulfite, sodium sulfate, sodium bisulfate, and sodium hydrosulfite (sodium dithionite). Persons skilled in the art will recognize additional compounds that are suitable particulate sulfur reagents.

A particulate phosphorous reagent is a particulate solid that includes at least one phosphorous atom and at least three oxygen atoms in the chemical formula (abbreviated hereafter as a "particulate $P_yO_x$ compound" where y is generally 1-2, and x≥2.0y. In exemplary particulate phosphorous reagents, when y=1, x is 3 or more, and when y=2, x=4 or more). Examples of phosphorous reagents include hydrogen phosphite ($HPO_3^{2-}$) compounds, monobasic phosphate ($H_2PO_4^{1-}$) compounds, dibasic phosphate compounds ($HPO_4^{2-}$), acid pyrophosphate ($H_2P_2O_7^{2-}$) compounds, and metaphosphate ($PO_3$) compounds. Specific examples include sodium hydrogen phosphite ($Na_2HPO_3$), ammonium hydrogen phosphite, ($(NH_4)_2HPO_3$), sodium phosphate monobasic ($NaH_2PO_4$), calcium phosphate monobasic ($Ca(H_2PO_4)_2$), ammonium phosphate monobasic ($NH_4)H_2PO_4$), sodium phosphate dibasic ($Na_2HPO_4$), ammonium phosphate dibasic ($(NH_4)_2HPO_4$), and sodium acid pyrophosphate ($Na_2H_2P_2O_7$). Persons skilled in the art will recognize additional compounds that are suitable particulate phosphorous reagents.

A particulate aluminum reagent is a particulate solid selected from a group of aluminum compounds. Specific examples include aluminum ammonium sulfate ($AlNH_4(SO_4)_2$), aluminum hydroxychloride ($Al_2(OH)_5CL$), aluminum oxide ($Al_2O_3$), aluminum potassium sulfate ($AlK(SO_4)_2$), aluminum sodium sulfate ($AlNa(SO_4)_2$), aluminum sulfate ($Al_2(SO_4)_3$), and various permutations of compounds frequently referred to as polyaluminum chlorides or aluminum chlorohydrates that are designated by the general formula ($Al_nCl_{(3n-m)}(OH)_m$. Persons skilled in the art will recognize additional compounds that are suitable particulate aluminum reagents.

A particulate silica reagent is a particulate solid that is classified as an amorphous silica or as an amorphous silicon dioxide (amorphous $SiO_2$). These silica reagents are sometimes also referred to as "precipitated silica."

A particulate carbonaceous reagent is a particulate solid that is classified as an activated carbon, and is interchangeably referred to herein as a particulate activated carbon. Any particulate activated carbon can be used; exemplary carbonaceous reagents include decolorizing activated carbons such as acid-activated decolorizing carbons. A particulate carbonaceous reagent can be any particulate carbonaceous reagent suitable for use in a sugar refining process. In exemplary embodiments, the particulate carbonaceous reagent can be in the range of, or have an average particle size in the range of, for example, from about 0.01 micron up to about 300 microns; from about 1 micron to about 300 microns; from about 5 microns to about 250 microns; or from about 50 microns to about 250 microns.

A particulate bleaching earth is any particulate solid classified as such, for example activated bleaching earth, acid-activated bleaching earth, fuller's earth, bentonite, hormite, smectite, and attapulgite clay.

A particulate filter aid is a particulate solid that is classified as a filter aid. Any particulate filter aid can be used; exemplary filter aids include although diatomaceous earth and perlite.

A polymer decolorant can be a liquid or waxy substance that is classified as a color precipitant for use in sugar solutions. Any polymer decolorant that is suitable for use in sugar solutions can be used; exemplary polymer decolorants include dimethylamine-epichlorohydrin, dimethyldialkylammonium chloride, and dimethyl-di-tallow ammonium chloride.

The compositions of the present invention can be added at any point in the sugar treatment process, where neutralizing some acidity or stabilizing pH is desirable. An example of where neutralization of some acidity is desirable occurs with the liquor that is being evaporated into crystal sugar. In this crystallization process, a pH drop almost always occurs; to avoid excess inversion of the sucrose sugars into glucose and fructose, it is desirable to neutralize some of the acidity in the liquor before it is evaporated into crystal sugars. In order to avoid/minimize inversion, it has been stated that all liquors and syrups (throughout the production process) should be kept over pH 7.0 (Cane Sugar Handbook, 12$^{th}$ Ed., pg 634). Other points throughout the production process of turning sugar solutions into crystal sugars are also suitable for neutralization of acidity or stabilization of pH. The present invention provides a composition and method that avoids dramatic changes in pH, particularly by preventing an undesirable increase in acidity of the sugar solution when for example an acid activated carbon is added to treat the sugar solution. The compositions of the present invention can also be utilized to neutralize basic sugar solutions under some conditions; for example when the pH of the sugar solution is sufficiently basic to enable these compositions to act as acids, i.e., these compositions can act as buffers to lower the pH of alkaline sugar solutions. The compositions can further be added at any suitable point in the sugar treatment process where reduction of colour molecules, or reduction of some ash compounds such as calcium and magnesium, is desirable.

Accordingly, compositions according to the invention offer several advantages over the prior art. One advantage is that the compositions enable the use of an acid-activated carbon (either within the composition itself, or added as an admixture with one or more compositions of the present invention) with less of a pH drop than would normally occur with the use of the acid-activated carbon. Acid activated Carbons are generally preferred because of their greater effectiveness in colour removal compared to more pH neutral activated carbons, but due to their acidic nature can cause problems with sugar inversion. Another advantage of the present compositions and method is that these beneficial effects on pH are often achieved simultaneously with an improvement in colour reduction. Compositions of the present invention have shown to have a higher decolorization capacity per unit weight compared to conventional acid activated carbons. The color removal capacity per unit weight of some compositions of the present invention have shown to be 15% higher than conventional acid activated carbon for example, and in some cases 20% higher, and in other cases 97% higher (almost double the decolourisation capacity per unit weight compared to the conventional acid activated carbon). Compositions of the present invention have also shown to have a higher decolorization capacity per unit weight compared to conventional near-neutral pH activated carbon, for example as much as 240% higher (almost 2.5 times the decolourisation capacity per unit weight compared to the conventional near-neutral pH activated carbon). In addition, use of compositions according to the invention can reduce the amount of unreacted calcium and/or magnesium components in the sugar solution, such as from the lime or milk of magnesia added during some sugar processing.

By way of example, when a near neutral (pH about 6.50 to about 7.50) sugar solution is treated with an Acid Activated Carbon, a pH drop of 0.40 pH units or more can occur. By incorporating the present compositions and methods into the treatment, the pH drop of the same solutions can be reduced to a drop of less than 0.20 units or less than 0.10 pH units. In some cases, an increase in pH can even be observed In extreme cases where the pH would otherwise drop by 0.60 or 0.70 units upon treatment with an acid activated carbon, use of the present compositions in the treatment can reduce the pH drop of the same solutions to less than 0.40, less than 0.30, of less than 0.20 or even less than 0.10 pH units. In other words, use of the present composition can reduce the pH change by about one half of the change would otherwise occur. Compositions according to the invention can also be used to stabilize or neutralize the pH in solutions where no acid activated carbon is added. For example, in a substantially acidic (pH<6.5) or substantially alkaline (pH>7.5) sugar solution, a more neutral pH can be obtained by adding compositions according to the invention. For example, in a solution with a pH between 6.0 and 6.5, the pH can be raised to a more neutral value (pH from about 6.5 to about 7.5). Even in very alkaline sugar solutions, the present compositions can significantly lower the pH by, for example, 0.2-1.5 pH units.

Compositions according to the invention can be added to sugar solutions for treatment at rates readily determined by persons skilled in the art. For example, by way of example, and without limitation, the compositions can be added at between about 0.002% to about 1% (by weight of either sugar solids in the sugar solution or by total weight of sugar solution), or from about 0.005% to about 0.75%, or from about 0.01% to about 0.5%, or from about 0.02% to about 0.25% by weight of either sugar solids in the sugar solution or by total weight of sugar solution.

Compositions that have more than one of the aforementioned components may show benefits greater than those having a single component. The individual components of the compositions can be added to the process singularly, or they can be prepared as admixtures and added as a composite to the process. Compositions can also be added by admixing some components before addition and adding other components individually. Multi-component compositions that are exemplary of the present invention include the following:

Exemplary Embodiment (1)

A mixture containing at least one compound containing a source of ammonium ($NH_4$) and that exhibits a pH in water solution above pH 7.0, and at least one particulate activated carbon. Examples of suitable sources of ammonium include but are not limited to (A) ammonium bicarbonate ($NH_4HCO_3$), (B) ammonium phosphate dibasic $(NH_4)_2HPO_4$, and (C) ammonium sulfite $(NH_4)_2SO_3$. The compound containing the source of ammonium can vary from about 0.1 to 80% (by weight) of the mixture, for example, from about 0.5 to 30%, or from about 0.5 to 5% of the mixture. The particulate activated carbon can vary from about 20 to 80% of the mixture, for example, from 40 to 80%, or from 55 to 70% of the mixture.

Exemplary Embodiment (2)

A mixture containing at least one compound containing a source of ammonium ($NH_4$) and that exhibits a pH in water solution above pH 7.0, and at least one particulate activated carbon, and at least one polymer decolorant. Examples of suitable sources of ammonium include but are not limited to (A) ammonium bicarbonate ($NH_4HCO_3$), (B) ammonium phosphate dibasic $(NH_4)_2HPO_4$, and (C) ammonium sulfite $(NH_4)_2SO_3$. The compound containing the source of ammonium can vary from about 0.1 to 80% (by weight) of the mixture, for example from about 0.5 to 30%, or from about 0.5 to 5% of the mixture. The particulate activated carbon can vary from about 20 to 80% of the mixture, for example from 40 to 80%, or from 55 to 70% of the mixture. The polymer decolorant can vary from about 5 to 50% of the mixture, for example from about 10 to 45%, or from about 20 to 40% of the mixture.

Exemplary Embodiment (3)

A mixture containing at least one compound containing a source of ammonium ($NH_4$) and that obtains a pH in water solution above pH 7.0, and at least one particulate activated carbon, and at least one polymer decolorant, and at least one silica such as amorphous silica. The compound containing the source of ammonium can vary from about 0.1 to 50% (by weight) of the mixture, for example, from about 0.5 to 30%, or from about 0.5 to 5% of the mixture. The particulate activated carbon can vary from about 20 to 80% of the mixture, for example, from 40 to 80%, or from 55 to 70% of the mixture. The polymer decolorant can vary from about 5 to 50% of the mixture, for example, from about 10 to 45%, or from about 20 to 40% of the mixture. The amorphous silica can vary from about 1 to 20% (by weight) of the mixture, for example, from 1 to 10%, or from 1 to 5% of the mixture.

Exemplary Embodiment (4)

A mixture containing at least one compound containing a source of ammonium ($NH_4$) and that obtains a pH in water solution above pH 7.0, and at least one particulate activated carbon, and at least one polymer decolorant, and at least one silica such as amorphous silica, and at least one particulate phosphorous reagent. The compound containing the source of ammonium can vary from about 0.1 to 50% (by weight) of the mixture, for example, from about 0.5 to 30%, or from about 0.5 to 15% of the mixture. The particulate activated carbon can vary from about 20 to 80% of the mixture, for example, from 40 to 80%, or from 55 to 70% of the mixture. The polymer decolorant can vary from about 5 to 50% of the mixture, for example, from about 10 to 45%, or from about 20 to 40% of the mixture. The amorphous silica can vary from about 1 to 20% (by weight) of the mixture, for example, from 1 to 10%, or from 1 to 5% of the mixture. The particulate phosphorous reagent can vary from about 1 to 20% (by weight) of the mixture, for example, from 1 to 10%, or from 1 to 5% of the mixture.

Exemplary Embodiment (5)

A mixture containing at least one compound containing a source of ammonium ($NH_4$) and that obtains a pH in water solution above pH 7.0, and at least one particulate activated carbon, and at least one polymer decolorant, and at least one silica such as amorphous silica, and at least one particulate sulfur reagent. The compound containing the source of ammonium can vary from about 0.1 to 50% (by weight) of the mixture, for example, from about 0.5 to 30%, or from about 0.5 to 15% of the mixture. The particulate activated carbon can vary from about 20 to 80% of the mixture, for example, from 40 to 80%, or from 55 to 70% of the mixture. The polymer decolorant can vary from about 5 to 50% of the mixture, for example, from about 10 to 45%, or from about 20 to 40% of the mixture. The amorphous silica can vary from about 1 to 20% (by weight) of the mixture, for example, from 1 to 10%, or from 1 to 5% of the mixture. The particulate sulfur reagent can vary from about 1 to 20% (by weight) of the mixture, for example, from 1 to 10%, or from 1 to 5% of the mixture.

Exemplary Embodiment (6)

A mixture containing at least one compound containing a source of ammonium ($NH_4$) and that obtains a pH in water solution above pH 7.0, and at least one particulate activated carbon, and at least one polymer decolorant, and at least one silica such as amorphous silica, and at least one particulate phosphorous reagent, and at least one particulate sulfur reagent. The compound containing the source of ammonium can vary from about 0.1 to 50% (by weight) of the mixture, for example, from about 0.5 to 30%, or from about 0.5 to 15% of the mixture. The particulate activated carbon can vary from about 20 to 80% of the mixture, for example, from 40 to 80%, or from 55 to 70% of the mixture. The polymer decolorant can vary from about 5 to 50% of the mixture, for example, from about 10 to 45%, or from about 20 to 40% of the mixture. The amorphous silica can vary from about 1 to 20% (by weight) of the mixture, for example, from 1 to 10%, or from 1 to 5% of the mixture. The particulate phosphorous reagent can vary from about 1 to 20% (by weight) of the mixture, for example, from 1 to 10%, or from 1 to 5% of the mixture. The particulate sulfur reagent can vary from about 1 to 20% (by weight) of the mixture, for example, from 1 to 10%, or from 1 to 5% of the mixture.

Exemplary Embodiment (7)

A mixture containing at least one compound containing a source of ammonium ($NH_4$) and that obtains a pH in water solution above pH 7.0, and at least one particulate activated carbon, and at least one polymer decolorant, and at least one silica such as amorphous silica, and at least one particulate phosphorous reagent, and at least one particulate sulfur reagent, and at least one particulate filter aid. The compound containing the source of ammonium can vary from about 0.1 to 50% (by weight) of the mixture, for example, from about 0.5 to 30%, or from about 0.5 to 15% of the mixture. The particulate activated carbon can vary from about 20 to 80% of the mixture, for example, from 40 to 80%, or from 55 to 70% of the mixture. The polymer decolorant can vary from about 5 to 50% of the mixture, for example, from about 10 to 45%, or from about 20 to 40% of the mixture. The amorphous silica can vary from about 1 to 20% (by weight) of the mixture, for example, from 1 to 10%, or from 1 to 5% of the mixture. The particulate phosphorous reagent can vary from about 1 to 20% (by weight) of the mixture, for example, from 1 to 10%, or from 1 to 5% of the mixture. The particulate sulfur reagent can vary from about 1 to 20% (by weight) of the mixture, for example, from 1 to 10%, or from 1 to 5% of the mixture. The particulate filter aid can vary from about 1 to 50% (by weight) of the mixture, for example, from 1 to 25%, or from 1 to 15% of the mixture.

Exemplary Embodiment (8)

A mixture containing at least one compound containing a source of ammonium ($NH_4$) and that obtains a pH in water solution above pH 7.0, and at least one particulate bleaching earth, and at least one silica such as amorphous silica. The compound containing the source of ammonium can vary from about 0.1 to 90% (by weight) of the mixture, for example, from about 0.5 to 70%, or from about 0.5 to 50% of the mixture. The particulate bleaching earth can vary from about 5 to 90% of the mixture, for example, from 5 to 70%, or from about 5 to 30% of the mixture. The amorphous silica can vary from about 1 to 20% (by weight) of the mixture, for example, from 1 to 10%, or from 1 to 5% of the mixture.

EXAMPLES

The following examples illustrate some compositions, usage methods, and advantages as described heretofore. The examples are illustrations of point only, and are not intended to limit the scope of our invention.

Example 1

A diluted polymer decolorant solution was first prepared by diluting a commercially available dimethylamine-epichlorohydrin polymer decolorant to prepare a solution containing 40% by weight polymer decolorant (in the as-is commercially available state) and 60% water (by weight). A composition (designated as "Composition #1" hereafter) was prepared containing 68.3% of a particulate acid activated carbon, 1.7% of ammonium bicarbonate, and 30% of the diluted polymer decolorant solution. An additional composition (designated as "Composition #2" hereafter) was prepared in an identical fashion, except the composition was contained 66.5% of a particulate acid activated carbon, 3.5% of ammonium bicarbonate, and 30% of the diluted polymer decolorant solution. Separately, a sugar liquor solution was prepared by dissolving a raw crystal sugar into water. Composition #1 was added to the sugar liquor at a dosage of 0.16% (weight of composition #1 with respect to the sugar solids dissolved in the sugar liquor). The sugar liquor was heated to 75-85 Celsius while mixing for 20 minutes. The sugar liquor was then filtered to measure the color removal and pH of the filtrate, compared to the color and pH of the untreated initial sugar liquor. The same test was performed using Composition #2 as well. A comparison test using the exact same methods was performed, except that the composition added to the sugar liquor was a conventional acid activated carbon added at 0.16% (weight of acid activated carbon with respect to the sugar solids dissolved in the sugar liquor). The results comparing Composition #1 and Composition #2 to the acid activated carbon are as shown in Table 1

As seen in Table 1, Compositions #1 and #2 removed more color than the acid activated carbon (263 color units and 254 color units respectively, compared to 220 color units for the acid activated carbon) while reducing the pH by only 0.37 and 0.27 pH units respectively, compared to the acid activated carbon pH reduction of 0.71 pH units. Compositions #1 and #2 are therefore seen to offer superior color reduction with less effect on the sugar pH compared to the conventional acid activated carbon.

TABLE 1

Comparison of color removal and pH change of sugar liquor treated with Composition #1, Composition #2, and conventional acid activated carbon

| Composition | Initial (untreated) Color | Filtrate Color | Color unit reduction | Initial pH | Filtrate pH | Change in pH |
|---|---|---|---|---|---|---|
| Composition #1 | 510 | 247 | 263 | 6.52 | 6.15 | −0.37 |
| Composition #2 | 510 | 256 | 254 | 6.52 | 6.25 | −0.27 |
| Acid Activated Carbon | 510 | 290 | 220 | 6.52 | 5.81 | −0.71 |

Example 2

A diluted polymer decolorant solution was first prepared by diluting a commercially available dimethyldialkylammonium chloride polymer decolorant to prepare a solution containing 60% by weight polymer decolorant (in the as-is commercially available state) and 40% water (by weight). A composition (designated as "Composition #3" hereafter) was prepared containing 61.7% of a particulate acid activated carbon, 3.3% of ammonium bicarbonate, and 35% of the diluted polymer decolorant solution. Separately, a sugar liquor solution was prepared by dissolving a raw crystal sugar into water. Composition #3 was added to the sugar liquor at a dosage of 0.10% (weight of composition #3 with respect to the sugar solids dissolved in the sugar liquor). The sugar liquor was heated to 75-85 Celsius while mixing for 20 minutes. The sugar liquor was then filtered to measure the color removal and pH of the filtrate, compared to the color and pH of the untreated initial sugar liquor. A comparison test using the exact same methods was performed, except that the composition added to the sugar liquor was a conventional acid activated carbon added at 0.10% (weight of acid activated carbon with respect to the sugar solids dissolved in the sugar liquor). The results comparing Composition #3 to the acid activated carbon are as shown in Table 2.

As seen in Table 2, Composition #3 removed more color than the acid activated carbon (250 color units compared to 175 color units) while reducing the pH by only 0.08 pH units compared to the acid activated carbon pH reduction of 0.45 pH units. Composition #3 is therefore seen to offer superior color reduction with less effect on the sugar pH compared to the conventional acid activated carbon.

TABLE 2

Comparison of color removal and pH change of sugar liquor treated with Composition #3 compared to acid activated carbon

| Composition | Initial (untreated) Color | Filtrate Color | Color unit reduction | Initial pH | Filtrate pH | Change in pH |
|---|---|---|---|---|---|---|
| Composition #3 | 537 | 287 | 250 | 6.50 | 6.42 | −0.08 |
| Acid Activated Carbon | 537 | 362 | 175 | 6.50 | 6.05 | −0.45 |

Example 3

Composition #3 was added to a different sugar liquor (prepared by dissolving a different raw sugar into water) at a dosage of 0.055% (weight of composition #3 with respect to the sugar solids dissolved in the sugar liquor). The sugar liquor was heated to 75-85 Celsius while mixing for 20 minutes. The sugar liquor was then filtered to measure the color removal and pH of the filtrate, compared to the color and pH of the untreated initial sugar liquor. A comparison test using the exact same methods was performed, except that the composition added to the sugar liquor was a conventional activated carbon that was manufactured specially to have a near-neutral pH. The conventional near-neutral pH activated carbon dosage added was 0.11% (weight of near-neutral activated carbon with respect to the sugar solids dissolved in the sugar liquor). The results comparing Composition #3 to the conventional near-neutral activated carbon are as shown in Table 3.

As seen in Table 3, Composition #3 removed more color than the conventional near-neutral activated carbon (192 color units compared to 159 color units) at only ½ the dosage of the conventional near-neutral activated carbon. The reduction in pH by only 0.09 pH units of Composition #3 is practically identical to the 0.07 unit pH drop with the conventional near-neutral activated carbon. Composition #3 is therefore seen to offer superior color reduction compared to the conventional near-neutral pH activated carbon, with similar very little effect on the sugar pH.

TABLE 3

Comparison of color removal and pH change of sugar liquor treated with Composition #3 compared to conventional near-neutral activated carbon

| Composition | Initial (untreated) Color | Filtrate Color | Color unit reduction | Initial pH | Filtrate pH | Change in pH |
|---|---|---|---|---|---|---|
| Composition #3 | 1486 | 1294 | 192 | 6.52 | 6.43 | −0.09 |
| Near-Neutral Activated Carbon | 1486 | 1327 | 159 | 6.52 | 6.45 | −0.07 |

Example 4

A diluted polymer decolorant solution was first prepared by diluting a commercially available dimethyldialkylammonium chloride polymer decolorant to prepare a solution containing 60% by weight polymer decolorant (in the as-is commercially available state) and 40% water (by weight). A composition (designated as "Composition #4" hereafter) was prepared containing 63% of a particulate acid activated carbon, 2% of ammonium bicarbonate, and 35% of the diluted polymer decolorant solution. Separately, a sugar liquor solution was prepared by dissolving a raw crystal sugar into water. Composition #4 was added to the sugar liquor at a dosage of 0.055% (weight of composition #4 with respect to the sugar solids dissolved in the sugar liquor). The sugar liquor was heated to 75-85 Celsius while mixing for 20 minutes. The sugar liquor was then filtered to measure the color removal and pH of the filtrate, compared to the color and pH of the untreated initial sugar liquor. A comparison test using the exact same methods was performed, except that the composition added to the sugar liquor was a conventional acid activated carbon added at 0.086% (weight of acid activated carbon with respect to the sugar solids dissolved in the sugar liquor). The results comparing Composition #4 to the acid activated carbon are as shown in Table 4.

As seen in Table 4, Composition #4 removed more color than the acid activated carbon (140 color units compared to 111 color units) while increasing the pH by 0.02 pH units compared to the acid activated carbon pH reduction of 0.43 pH units. Composition #4 is therefore seen to offer superior color reduction while buffering the sugar liquor to obtain an increase in the treated sugar liquor pH, compared to the pH decrease observed with the conventional acid activated carbon.

TABLE 4

Comparison of color removal and pH change of sugar liquor treated with Composition #4 compared to acid activated carbon

| Composition | Initial (untreated) Color | Filtrate Color | Color unit reduction | Initial pH | Filtrate pH | Change in pH |
|---|---|---|---|---|---|---|
| Composition #4 | 267 | 127 | 140 | 7.05 | 7.07 | 0.02 |
| Acid Activated Carbon | 267 | 156 | 111 | 7.05 | 6.62 | −0.43 |

Example 5

A diluted polymer decolorant solution was first prepared by diluting a commercially available dimethyldialkylammonium chloride polymer decolorant to prepare a solution containing 55% by weight polymer decolorant (in the as-is commercially available state) and 45% water (by weight). A composition (designated as "Composition #5" hereafter) was prepared containing 52.5% of a particulate acid activated carbon, 3.8% of a particulate perlite filter aid, 3.2% of ammonium bicarbonate, 1.6% of sodium phosphate monobasic ($NaH_2PO_4$), 1.6% of sodium metabisulfite, 1.3% of a particulate silica reagent, and 36% of the diluted polymer decolorant solution. Separately, a sugar liquor solution was prepared by dissolving a raw crystal sugar into water. Composition #5 was added to the sugar liquor at a dosage of 0.063% (weight of composition #5 with respect to the sugar solids dissolved in the sugar liquor). The sugar liquor was heated to 75-85 Celsius while mixing for 20 minutes. The sugar liquor was then filtered to measure the color removal and pH of the filtrate, compared to the color and pH of the untreated initial sugar liquor. The results are presented in Table 5.

As seen in Table 5, Composition #5 removed 28% of the color from the untreated feed, while resulting in a pH increase of 0.05 pH units compared to the untreated feed.

TABLE 5

Color and pH change of sugar liquor treated with Composition #5 compared to the untreated sugar liquor

| Composition | Filtrate Color | Filtrate pH | Change in pH |
|---|---|---|---|
| Composition #5 | 1577 | 6.65 | +0.05 |
| Untreated sugar | 2191 | 6.60 | 0 |

Example 6

Compositions were prepared for evaluation of calcium reduction. Composition #6 was prepared containing 65% powder activated carbon, 23% ammonium bicarbonate, and 12% perlite filter aid. Composition #7 was prepared containing 67% ammonium bicarbonate, 30% particulate bleaching earth, and 3% particulate precipitated silica. Separately, a sugar liquor solution was prepared by dissolving a refined crystal sugar into water. Lime ($Ca(OH)_2$) was added to achieve 300 ppm ($CaCO_3$ basis) calcium hardness. Composition #6 was added to the sugar liquor at a dosage of 0.05% (weight of composition #6 with respect to the total weight of sugar liquor). Composition #7 was added in the same manner, in a separate test. Compositions 6 and 7 were mixed with the sugar liquor for 10 minutes. The sugar liquor was then filtered to measure the calcium concentration of the filtrate, compared to the calcium concentration of the untreated initial sugar liquor. The results are presented in Table 6.

As seen in Table 6, Compositions #6 and #7 imparted calcium reduction compared to the untreated sugar liquor.

TABLE 6

Calcium concentration of sugar liquor treated with Composition #6 and #7 compared to the untreated sugar liquor

| Composition | ppm Calcium hardness (as $CaCO_3$) |
|---|---|
| Composition #6 | 225 |
| Composition #7 | 60 |
| Untreated sugar | 300 |

Example 7

A commercially available particulate ammonium bicarbonate was tested on various sugar solutions. One of the sugar solutions was spiked with lime hydrate to obtain a calcium concentration of 350 ppm (as $CaCO_3$). This limed-spiked sugar solution was then treated with the particulate ammonium bicarbonate, at a dosage of 0.025% (by weight of sugar solution). The pH and calcium content of the sugar solution is as shown in Table 7.

As seen in Table 7, the ammonium bicarbonate acted to reduce the pH of solution, while substantially reducing the calcium content of the sugar solution.

TABLE 7

Calcium concentration and pH of sugar solution treated with ammonium bicarbonate compared to untreated sugar solution

| Composition | ppm Calcium hardness (as $CaCO_3$) | pH |
|---|---|---|
| Untreated sugar solution | 350 | 10.8 |
| Treated with 0.025% ammonium bicarbonate | <50 | 9.4 |

Another sugar solution was prepared with no lime addition. This sugar solution was treated with 0.02% (by total weight of sugar solution) of the particulate ammonium bicarbonate. The results are presented in Table 8:

TABLE 8 pH of sugar solution treated with ammonium bicarbonate compared to untreated sugar solution

| Composition | pH |
|---|---|
| Untreated sugar solution | 6.1 |
| Treated with 0.02% ammonium bicarbonate | 7.3 |

As seen in Table 8, the pH of the sugar solution was increased with the ammonium bicarbonate, obtaining a close to neutral pH sugar solution.

Another sugar solution was prepared and spiked with 120 parts per million of lime hydrate (basis dissolved sugar solids in the sugar solution). This sugar solution was treated with 0.035% (by weight of dissolved sugar solids in the sugar solution) of the particulate ammonium bicarbonate. The results are presented in Table 9.

As seen in Table 9, the ammonium bicarbonate acted to reduce the pH of the sugar solution, as well as to reduce the colour of the sugar solution.

TABLE 9

Colour and pH of sugar solution treated with ammonium bicarbonate compared to untreated sugar solution

| Composition | Colour | pH |
|---|---|---|
| Untreated sugar solution | 3083 | 8.0 |
| Treated with 0.035% ammonium bicarbonate | 2892 | 7.8 |

The present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the composition or method shown is intended only for illustration and disclosure of an operative embodiment and not to show all of the various forms or modifications in which this invention might be embodied or operated. All examples are non-limiting and exemplary.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A sugar treatment process comprising adding a mixture of one or more compounds that are sources of ammonium that obtain a pH in water solution above pH 7.0 and at least one particulate activated carbon to a sugar solution, wherein the sugar treatment provides at least one effect selected from stabilizing the pH of the sugar solution; reducing the calcium, magnesium or related ash constituents of the sugar solution; and color reduction of the sugar solution, wherein the source of ammonium is selected from the group consisting of ammonium bicarbonate ($NH_4HCO_3$), ammonium phosphate dibasic $(NH_4)_2HPO_4$, and ammonium sulfite $(NH_4)_2SO_3$.

2. The process of claim 1, wherein the addition of the source of ammonium controls the pH of the sugar solution by raising the pH of the sugar solution if the sugar solution is acidic or lowering the pH of the sugar solution if the sugar solution is alkaline.

3. The process of claim 1, further comprising adding at least one ingredient selected from the group consisting of a particulate sulfur reagent, an amorphous silica, a particulate aluminum reagent, a particulate phosphorous reagent, a particulate filter aid selected from diatomaceous earth and perlite, a particulate bleaching earth, and a polymer decolorant, and combinations thereof.

4. The process of claim 3, further comprising mixing one or more ingredients before adding to the sugar solution.

5. The process of claim 1, further comprising adding at least one polymer decolorant to the mixture.

6. The process of claim 1, further comprising preparing a polymer decolorant solution; adding the mixture of one or more sources of ammonium and at least one particulate activated carbon to the polymer decolorant solution to prepare a treatment composition and adding the treatment composition to the sugar solution.

7. The process of claim 5, further comprising adding at least one ingredient selected from the group consisting of a particulate sulfur reagent, an amorphous silica, a particulate aluminum reagent, a particulate phosphorous reagent, a particulate filter aid selected from diatomaceous earth and perlite, and a particulate bleaching earth, and combinations thereof.

8. The process of claim 1, further comprising adding a particulate filter aid selected from diatomaceous earth and perlite, and combinations thereof.

9. The process of claim 1, further comprising adding a bleaching earth, and adding an amorphous silica.

* * * * *